US006460967B1

(12) United States Patent
Makita et al.

(10) Patent No.: US 6,460,967 B1
(45) Date of Patent: Oct. 8, 2002

(54) LIQUID JETTING APPARATUS

(75) Inventors: Masahiro Makita; Yoshikazu Maekawa; Takuo Nishikawa, all of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/273,294

(22) Filed: Mar. 19, 1999

(30) Foreign Application Priority Data

Mar. 24, 1998 (JP) ..... 10-075128
Mar. 26, 1998 (JP) ..... 10-079323

(51) Int. Cl.[7] ..... B41J 2/165
(52) U.S. Cl. ..... 347/33
(58) Field of Search ..... 347/33, 22, 28

(56) References Cited

U.S. PATENT DOCUMENTS

| | | | |
|---|---|---|---|
| 4,199,769 | A | 4/1980 | Fischbeck |
| 4,668,965 | A | 5/1987 | Tanaka et al. |
| 4,727,378 | A | 2/1988 | Le et al. |
| 5,081,472 | A | 1/1992 | Fisher |
| 5,432,539 | A | 7/1995 | Anderson |
| 5,489,928 | A | 2/1996 | Takahashi et al. |
| 5,559,540 | A | 9/1996 | Burolla |
| 5,570,116 | A | 10/1996 | Soga |
| 5,663,751 | A | 9/1997 | Holbrook |

FOREIGN PATENT DOCUMENTS

| | | |
|---|---|---|
| EP | 0 476 679 A2 | 3/1992 |
| EP | 0 541 519 A2 | 5/1993 |
| EP | 0 631 873 A1 | 1/1995 |
| EP | 0 709 204 A1 | 5/1996 |
| JP | 4-185450 | 7/1992 |
| JP | 6-79880 | 3/1994 |

OTHER PUBLICATIONS

Patent Abstracts of Japan, vol. 014, No. 147 (M–0952), Mar. 20, 1990 & JP 02 011332 A (Canon Inc) Jan. 16, 1990.

Patent Abstracts of Japan, vol. 014, No. 256 (M–0980), Jun. 4, 1990 & JP 02 072961 A (Fuji Xerox Co Ltd), Mar. 13, 1990.

*Primary Examiner*—Huan Tran
(74) *Attorney, Agent, or Firm*—Frishauf, Holtz, Goodman & Chick, P.C.

(57) ABSTRACT

In a liquid jetting apparatus provided with a head provided with a liquid jetting section; a feeding section for feeding a liquid to the head; and a control section for controlling the liquid jetting section to jet the liquid such that a jetting trace of the liquid is recorded on a recording medium; the liquid jetting apparatus is further provided with a liquid ejecting section for varying a pressure in the head in plural steps so as to eject the liquid in the head from the liquid jetting section.

27 Claims, 13 Drawing Sheets

LIQUID JETTING APPARATUS

BACKGROUND OF THE INVENTION

The present invention relates to a liquid jetting device, and in particular, to a liquid jetting device wherein a liquid is jetted from a liquid jetting section, and a jetted trace of the liquid is recorded on a recording medium such as paper, cloth, nonwoven fabric and a plastic film, as, for example, in an ink jet printer.

In the case of an ink jet printer used for cloth, for example, a drop of ink (liquid) is jetted from a nozzle of a liquid jetting section, namely, of a print head onto a web (recording medium) on a platen so as to print a pattern. In the case of a color print, a print head has thereon ink heads which are respectively for the four primary colors of cyan, magenta, yellow and black, for example, and a combination of ink dots jetted from various ink heads expresses various colors and patterns. Combinations of colors of ink dots and patterns formed by them are specified by image forming data supplied from the control unit (computer). Density of ink dots constituting a pattern is usually between several hundred dpi to more than one thousand dpi.

Ink is supplied to a print head directly from an ink tank or through an ink tube. When letting ink run through a path from the ink tank to the print head initially, a pressure difference which makes the pressure on the part of the ink tank to be higher relatively than that on the part of the tip of the print head is given between the ink tank and the tip of the print head, to feed ink forcibly. The pressure is generated by suction or pressurization caused by a pump. Even when a nozzle of a print head is clogged with foreign substances such as dust or air bubbles, the foreign substances are ejected out of the nozzle together with ink by force feeding. The force feeding of ink of this kind for ejection of foreign substances is also conducted under the pressure which is the same as that in initial ink running.

When the pressure which is the same as that in initial ink running is used in force feeding of ink for ejection of foreign substances, air bubbles have failed to be ejected out sufficiently, depending on their size and location, which has been a problem.

To be concrete, an air bubble which is produced in an ink tube and is relatively large is easily fed forcibly by a high pressure, but when it fragments into small air bubbles, they are hardly moved. When such air bubbles are deposited in an ink manifold of an ink head, they affect ink jet operations, while when air bubbles which are further smaller are stuck to an inner wall of a jetting channel (nozzle) of the ink head, the jetting direction of ink loses its accuracy.

The diameter of the nozzles of the print heads capable of making a print having such a high dot density mentioned above is extremely small, and jetting failure caused by adhesion of dyes or pigments of the ink tends to occur, requiring cleaning of the print head on a timely basis.

As an example of a conventional liquid jetting device equipped with a cleaning unit for the print heads, there is described a device in TOKKAIHEI 4-185450, for example. In this device, a cleaning roller made of porous material is brought into contact with a print head, and thereby smudges on the nozzle plane are absorbed when the cleaning roller is rotated on the nozzle plane by travel of the print head.

Further, as another example of a conventional liquid jetting device equipped with a cleaning unit for a print head, there is described, for example, a device in TOKKAIHEI 6-079880. In this device, a cleaning blade made of porous material is caused to hold a cleaning liquid and is brought into contact with the print head, so that the front surface of the print head is wiped by the cleaning blade as the print head travels along its limited path.

In the aforesaid example of the conventional jetting device, the print head is brought into contact with a cleaning roller or a cleaning blade whose position is fixed so as to clean the ink jetting plane by utilizing sucking action or wiping action based on traveling of the print head. However, the traveling speed of the print head is the same as the main scanning speed in the course of printing, or it can not be changed greatly even if it is changed. Therefore, the desired cleaning needs to be conducted within a given range of traveling speed, requiring hard work in selection of materials and shapes of a cleaning roller or the cleaning blade, or in selection of the cleaning liquid, which has been a problem.

In particular, in the conventional device described in TOKKAIHEI 4-185450, the cleaning effect is insufficient because smudges stuck on the nozzle plane can not be scraped off, though smudges on the nozzle plane can be absorbed, due to utilization of rotations of a cleaning roller on the print head surface. In the conventional device described in TOKKAIHEI 6-079880, on the other hand, a mechanism for supplying a cleaning liquid and a mechanism for absorbing smudges are complicated, and sufficient effect of cleaning is not always obtained, because the same contact surface of the cleaning blade is always used.

SUMMARY OF THE INVENTION

The present invention has been achieved to solve the problems mentioned above, and its object is to materialize a liquid jetting device wherein foreign substances and air bubbles contained in a liquid are appropriately removed and a liquid jetting section is cleaned appropriately.

The object stated above can be attained by the following structures.

(A) A liquid jetting apparatus, comprises a head provided with a liquid jetting section;

a feeding means for feeding a liquid to the head;

a control section for controlling the liquid jetting section to jet the liquid such that a jetting trace of the liquid is recorded on a recording medium; and a liquid ejecting means for varying a pressure in the head by plural steps so as to eject the liquid in the head from the liquid jetting section.

Here, as the liquid ejecting means for varying a pressure in the head in plural steps so as to eject the liquid in the head from the liquid jetting section, it may be permissible to be able to merely vary the pressure in the head by plural steps. The liquid ejecting means includes a case that the pressure steps in the head are changed differently in accordance with an objective of liquid ejection, the property of foreign material, and the kind of liquid and a case the pressure is varied by plural pressure steps by only a single ejecting action.

(B) A liquid jetting apparatus, comprises:

a head provided with a liquid jetting section;

a feeding means for feeding a liquid to the head;

a control means for controlling the liquid jetting section to jet the liquid such that a jetting trace of the liquid is recorded on a recording medium;

a wiping means for wiping the liquid jetting section of the head, the wiping section being rotatable and having an outer peripheral surface at least on which a wiping member having a liquid-absorbing characteristic is provided;

a driving means for rotating the wiping means; and a cleaning liquid feeding means for feeding a cleaning liquid to the wiping means.

Further, the object stated above can be attained by the following structures as a preferable embodiment. (Item 1) A liquid jetting device to jet a liquid from a liquid jetting section and to record a jetted trace of the liquid on a recording medium, wherein there is provided a liquid ejecting means in which the pressure is varied in plural steps to eject the liquid from the liquid jetting section.

In the invention of Item 1, the liquid ejecting means can conduct liquid ejection which is in conformity with properties of foreign substances, by varying the pressure in plural steps. Incidentally, air bubbles are included in the category of foreign substances. (Item 2) The liquid jetting device described in Item 1, wherein the liquid ejecting means stated above is provided with a pressure releasing means.

In the invention of Item 2, the pressure releasing means gives the time constant for increase or decrease of pressure. (Item 3) The liquid jetting device described in Item 2, wherein a pressure releasing gateway of the pressure releasing means can be opened and closed.

In the invention of Item 3, the pressure releasing means opens or closes the pressure releasing gateway to adjust the time constant. (Item 4) The liquid jetting device described in either one of Item 1–Item 3, wherein the pressure is varied in at least two steps in the liquid ejecting means.

In the invention of Item 4, the liquid ejecting means conducts liquid ejection which is in conformity with properties of foreign substances, by varying the pressure in two steps. Incidentally, air bubbles are included in the category of foreign substances. (Item 5) The liquid jetting device described in Item 4, wherein the pressure is varied in three steps in the liquid ejecting means.

In the invention of Item 5, the liquid ejecting means conducts liquid ejection which is in conformity with properties of foreign substances, by varying the pressure in three steps. (Item 6) The liquid jetting device described in Item 5, wherein the relatively high pressure is used by the liquid ejecting means when it conducts initial running of the liquid for the liquid jetting section and/or unclogging of the liquid jetting section, the relatively low pressure is used by the liquid ejecting means when it removes air bubbles in the liquid manifold of the liquid jetting section, and the relatively lower pressure is used by the liquid ejecting means when it removes air bubbles in the jetting channel of the liquid jetting section.

In the invention of Item 6, the liquid ejecting means uses pressures in three steps each in its proper way, for initial running of a liquid and/or unclogging of the liquid jetting section, removing air bubbles in the liquid manifold and for removing air bubbles in the jetting channel. (Item 7) The liquid jetting device described in either one of Item 1–Item 6, wherein the pressures in plural steps are generated by intermittent operations of a pump in the liquid ejecting means.

In the invention of Item 7, the liquid ejecting means adjusts the pressure by means of a pulse width of intermittent operations of a pump. (Item 8) The liquid jetting device described in either one of Item 1–Item 6, wherein the pressures in plural steps are generated by intermittent operations of a pump in the liquid ejecting means.

In the invention of Item 8, the liquid ejecting means adjusts the pressure through the speed of a continuous operation of a pump. (Item 9) The liquid jetting device described in either one of Item 1–Item 6, wherein the liquid ejecting means generates the relatively high pressure through intermittent operations of a pump and generates the relatively low pressure through a continuous operation of a pump.

In the invention of Item 9, the liquid ejecting means adjusts the relatively high pressure by means of a pulse width of intermittent operations of a pump and adjusts the relatively low pressure by means of the speed of a continuous operation of a pump. (Item 10) The liquid jetting device described in either one of Item 1–Item 6, wherein the liquid ejecting means generates the relatively high pressure through a continuous operation of a pump and generates the relatively low pressure through intermittent operations of a pump.

In the invention of Item 10, the liquid ejecting means adjusts the relatively high pressure by means of the speed of a continuous operation of a pump and adjusts the relatively low pressure by means of a pulse width of intermittent operations of a pump. (Item 11) The liquid jetting device described in either one of Item 1–Item 10, wherein the liquid ejecting means generates pressures in plural steps through suction.

In the invention of Item 11, the liquid ejecting means imposes pressures in plural steps on a liquid. (Item 12) The liquid jetting device described in either one of Item 1–Item 10, wherein the liquid ejecting means generates pressures in plural steps through pressurization.

In the invention of Item 12, the liquid ejecting means imposes pressures in plural steps on a liquid through pressurization. (Item 13) A liquid jetting device to jet a liquid from a liquid jetting section and to record a jetted trace of the liquid onto a recording medium, wherein there are provided a wiping means which wipes the liquid jetting section with an outer circumferential surface of its cylindrical wiping member that has a liquid-impregnating characteristic and rotates and a cleaning liquid supplying means which supplies a cleaning liquid to the wiping means mentioned above.

In the invention of Item 13, a cleaning liquid impregnated wiping means is rotated to wipe the liquid jetting section and thereby to clean it. (Item 14) The liquid jetting device described in Item 13, wherein the outer circumferential surface of the wiping member stated above moves relatively to the liquid jetting section in the course of wiping.

In the invention of Item 14, the liquid jetting section is wiped and cleaned when the outer circumferential surface of the wiping member moves relatively to the liquid jetting section. (Item 15) An invention of Item 15 for solving the problem is the liquid jetting device described in Item 14, wherein the speed of the aforesaid relative movement is 900 mm/s or less.

In the invention of Item 15, appropriate cleaning is conducted when the speed of relative movement is not more than 900 mm/s. (Item 16) The liquid jetting device described in either one of Item 13–Item 515 wherein the outside diameter of the wiping member is 5–50 mm and the inside diameter of the wiping member is 1–40 mm.

In the invention of Item 16, when using a wiping member whose outside diameter is 5–50 mm and inside diameter is 1–40 mm, an appropriate liquid-impregnating characteristic and wiping property can be materialized. (Item 17) The liquid jetting device described in either one of Item 13–Item 16, wherein the wiping member is made of a porous material having continuing air bubbles.

In the invention of Item 17, an appropriate liquid-impregnating characteristic and wiping property are materialized by a wiping member employing a porous material having continuing air bubbles. (Item 18) The liquid jetting device described in Item 17, wherein the porous material has its average porosity of 70% or more.

In the invention of Item 18, an appropriate liquid-impregnating characteristic or liquid-absorbing characteristic and wiping property are materialized when using a porous material having an average porosity of 70% or more. (Item 19) The liquid jetting device described in either Item 17 or Item 18, wherein the porous material has its average blow hole diameter of not more than 400 $\mu$m.

In the invention of Item 19, an appropriate liquid-impregnating characteristic and wiping property are materialized when a porous material having an average blow hole diameter of not more than 400 $\mu$m is used. (Item 20) The liquid jetting device described in either one of Item 13–Item 19, wherein the wiping means is provided with a fluctuating means which brings the wiping member into contact with the liquid jetting section and separates the wiping member from the liquid jetting section.

In the invention of Item 20, the fluctuating means brings the wiping member into contact with the liquid jetting section in the case of cleaning, and separates the wiping member from the liquid jetting section when cleaning is not conducted. (Item 21) The liquid jetting device described in either one of Item 12–Item 20, wherein the cleaning liquid supplying means supplies a cleaning liquid whose properties are similar to those of the liquid jetted by the liquid jetting section.

In the invention of Item 21, the influence of the cleaning liquid on a liquid jetted by the liquid jetting section is minimized by using a cleaning liquid whose properties are similar to those of a liquid jetted by the liquid jetting section. (Item 22) The liquid jetting device described in either one of Item 12–Item 21, wherein there is provided an impregnation amount adjusting means which adjusts an impregnation amount of the cleaning liquid in the wiping member by removing a part of the leaning liquid impregnated in the wiping member from the wiping member.

In the invention of Item 22, appropriate cleaning is realized by adjusting an impregnation amount of a cleaning liquid in the wiping member with the impregnation amount adjusting means. (Item 23) The liquid jetting device described in Item 22, wherein the impregnation amount adjusting means reduces an outside diameter of the wiping member partially.

In the invention of Item 23, a cleaning liquid in an appropriate amount is squeezed out when the impregnation amount adjusting means reduces an outside diameter of the wiping member partially. (Item 24) The liquid jetting device described in Item 23, wherein the impregnation amount adjusting means reduces a thickness of the wiping member by 50% of the thickness–0.5 mm.

In the invention of Item 24, an adjustment to an appropriate impregnation amount of a cleaning liquid can be materialized when the impregnation amount adjusting means reduces a thickness of the wiping member by 50% of the thickness–0.5 mm. (Item 25) The liquid jetting device described in either one of Item 22–Item 24, wherein the impregnation amount adjusting means is provided with a fluctuating means which brings the impregnation amount adjusting member into contact with the wiping member and separates the impregnation amount adjusting member from the wiping member.

In the invention of Item 25, the fluctuating means brings the impregnation amount adjusting member into contact with the wiping member in the case of cleaning, and separates the impregnation amount adjusting member from the wiping member when cleaning is not conducted. (Item 26) The liquid jetting device described in either one of Item 22–Item 25, wherein the wiping means wipes the liquid jetting section with its wiping member whose impregnation amount of the cleaning liquid has been adjusted by the impregnation amount adjusting means.

The invention of Item 26 makes it possible to clean the liquid jetting section appropriately by wiping the liquid jetting section with the wiping member impregnating the cleaning liquid which has been adjusted in terms of quantity. (Item 27) The liquid jetting device described in either one of Item 13–Item 26, wherein there is provided a cleaning liquid collecting means which collects the aforesaid cleaning liquid.

In the invention of Item 27, the collecting means collects an excessive or used cleaning liquid. (Item 28) The liquid jetting device described in either one of Item 13–Item 27, which is used for printing on a web.

In the invention of Structure 28, the liquid jetting device is used for printing on a web.

DETAILED DESCRIPTION OF THE PREFFERED EMBODIMENT

An embodiment of the invention will be explained in detail as follows, referring to drawings. Incidentally, the invention is not limited to the embodiment. In addition, in the following explanation, the recording medium is a cloth. However, the recording medium is not limited to a cloth, but it includes nonwoven fabric, paper, plastic film and all other media capable of holding jetted trace of a liquid.

Figure 1:
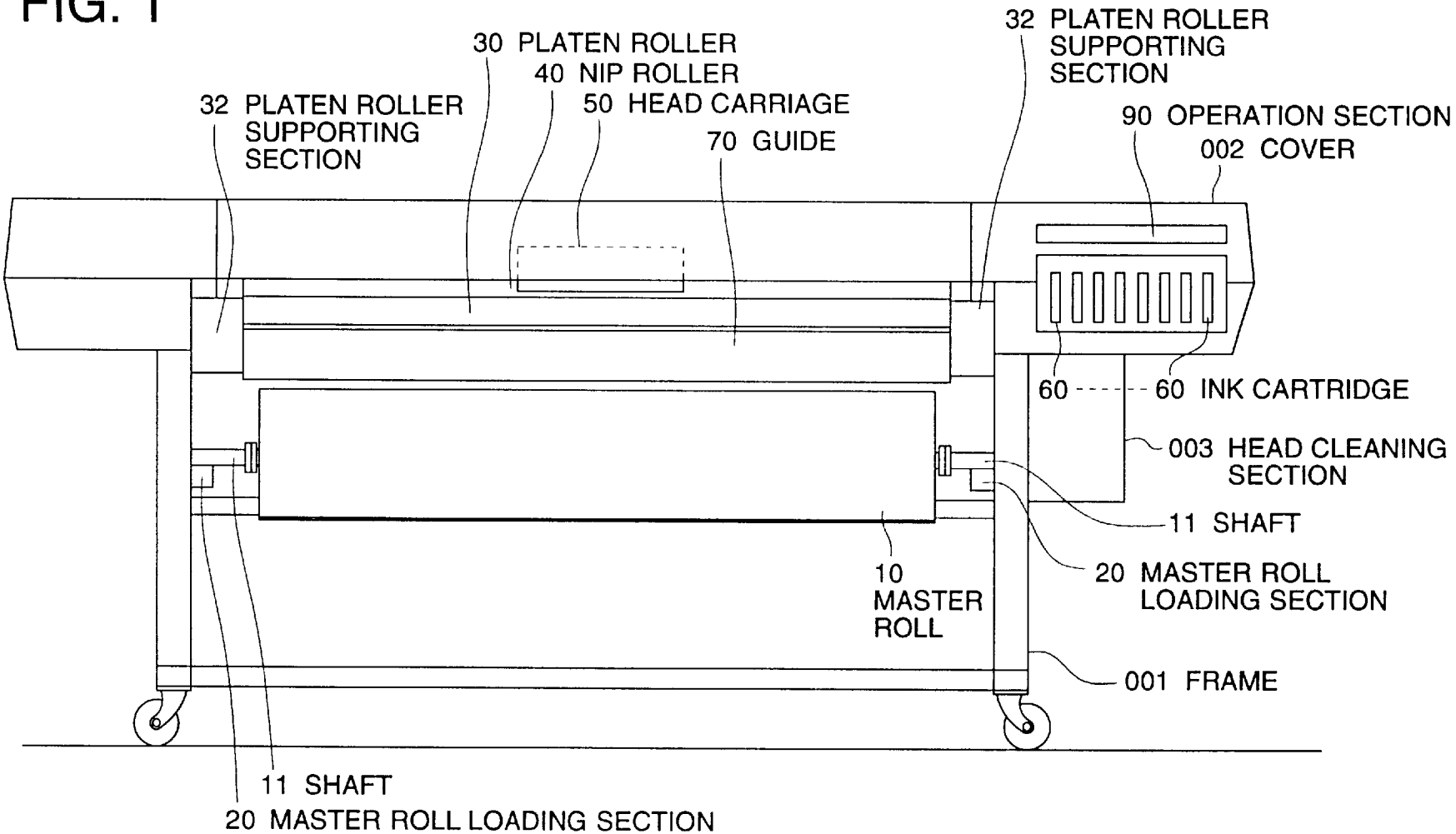
FIG. 1 is a front view of an apparatus in an example of the embodiment of the invention.
Figure 2:
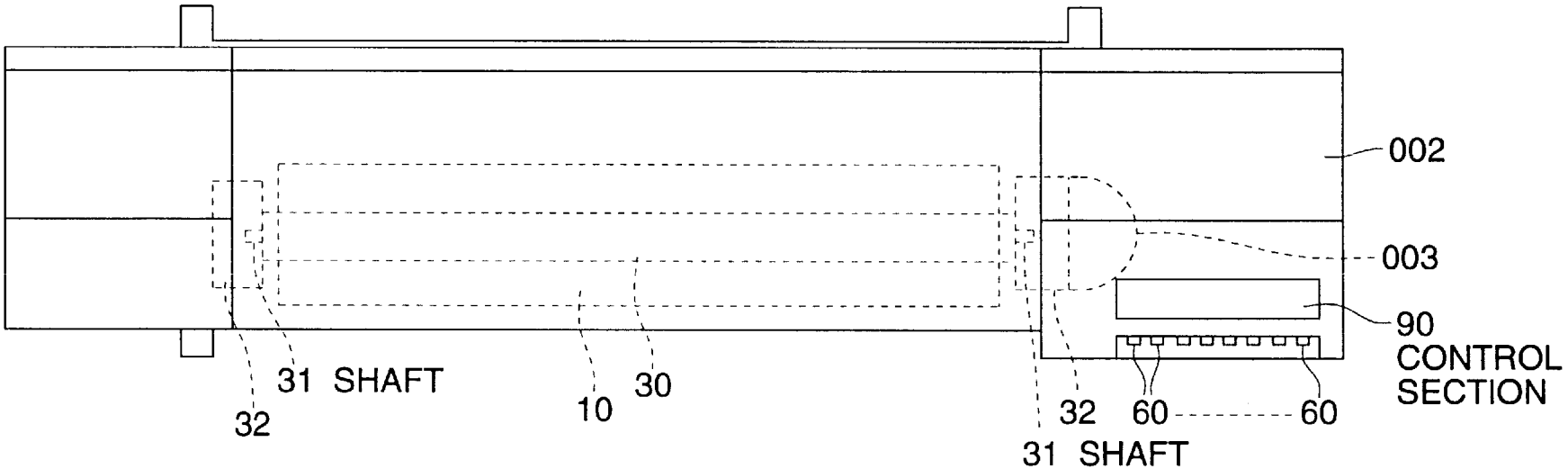
FIG. 2 is a top view of an apparatus in an example of the embodiment of the invention.
Figure 3:
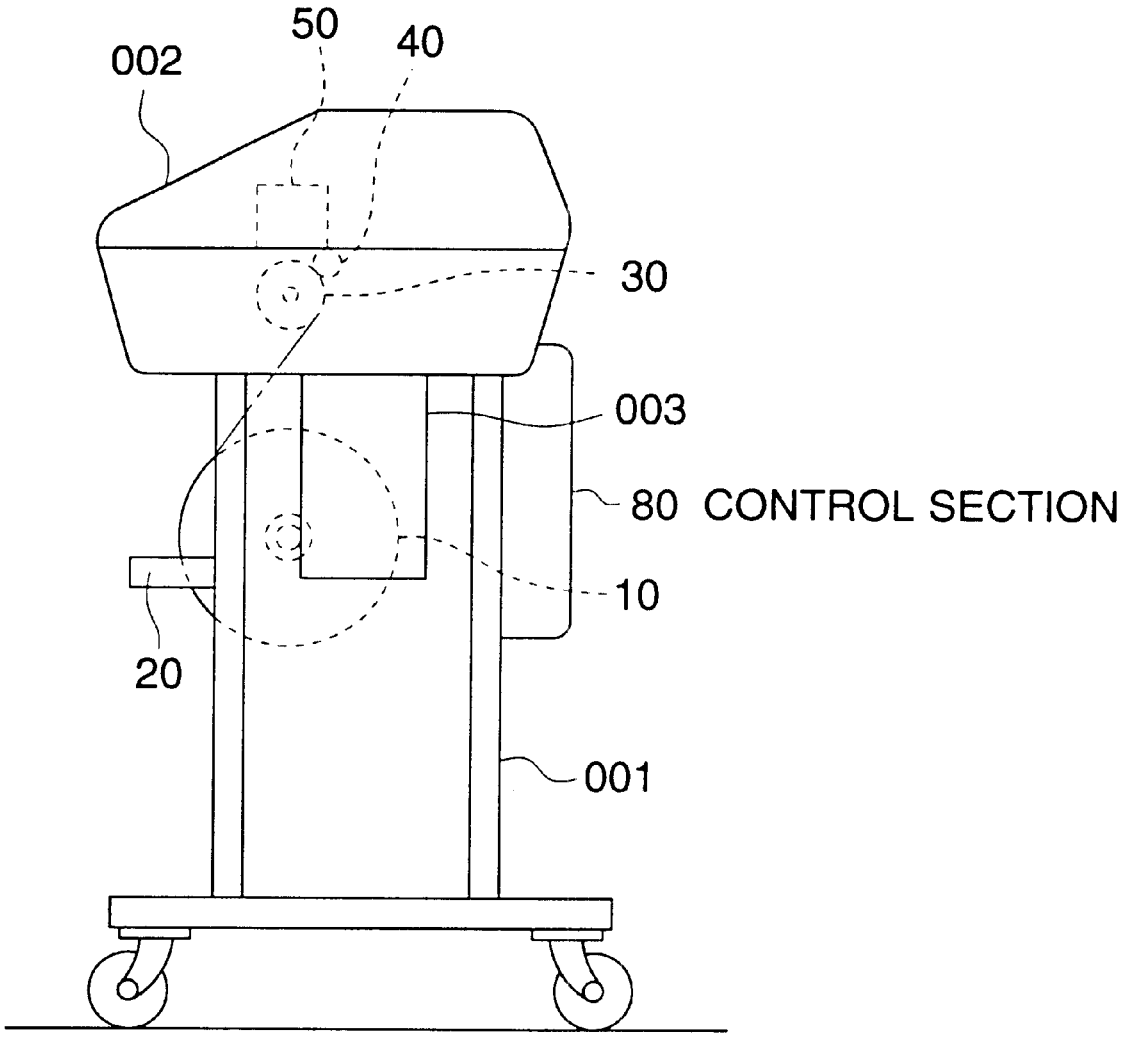
FIG. 3 is a side view of an apparatus in an example of the embodiment of the invention.

Each of FIGS. 1–3 shows an external view of an ink jet printer. FIG. 1 is a front view, FIG. 2 is a plan view and FIG. 3 is a right side view. The present apparatus is an example of an embodiment of a liquid jetting device of the invention. First of all, the overall structure of the apparatus will be explained. As shown in FIGS. 1–3, the apparatus is provided with frame 001, cover 002 and head cleaning section 003, and components described below are incorporated in either the frame 001, the cover 002 or the head cleaning section 003.

Master roll 10 of a web is loaded, with horizontally mounted shaft 11, in master roll loading section 20. The web is an example of the embodiment of a recording medium in the invention. On the upper side of the master roll 10, there is installed platen roller 30 to be in parallel with the master roll 10. The platen roller 30 is larger than the master roll 10 in terms of width.

Shaft 31 of the platen roller 30 is supported, at its both ends, by platen roller supporting sections 32. On the platen roller supporting section 32, there is provided an unillustrated driving section which rotates the platen roller 30.

Platen roller 30 is kept in touch with nip roller 40 on the back side of the platen roller. The nip roller 40 ensures conveyance of the web conducted by the platen roller 30, by pressing the web against the platen roller 30. A shaft of the nip roller 40 is supported rotatably. A width of the nip roller 40 is the same as that of the platen roller 30.

Above the upper side of the platen roller 30, there is provided head carriage 50. On the head carriage 50, there are mounted plural ink heads corresponding to the four primary colors for color prints, for example, and driving circuits therefor, as stated later. The ink head is an example of the embodiment of the liquid jetting section in the invention. An ink jetting surface (nozzle surface) of the ink head faces the platen roller 30. Incidentally, the print head will be explained again later.

Figure 4:
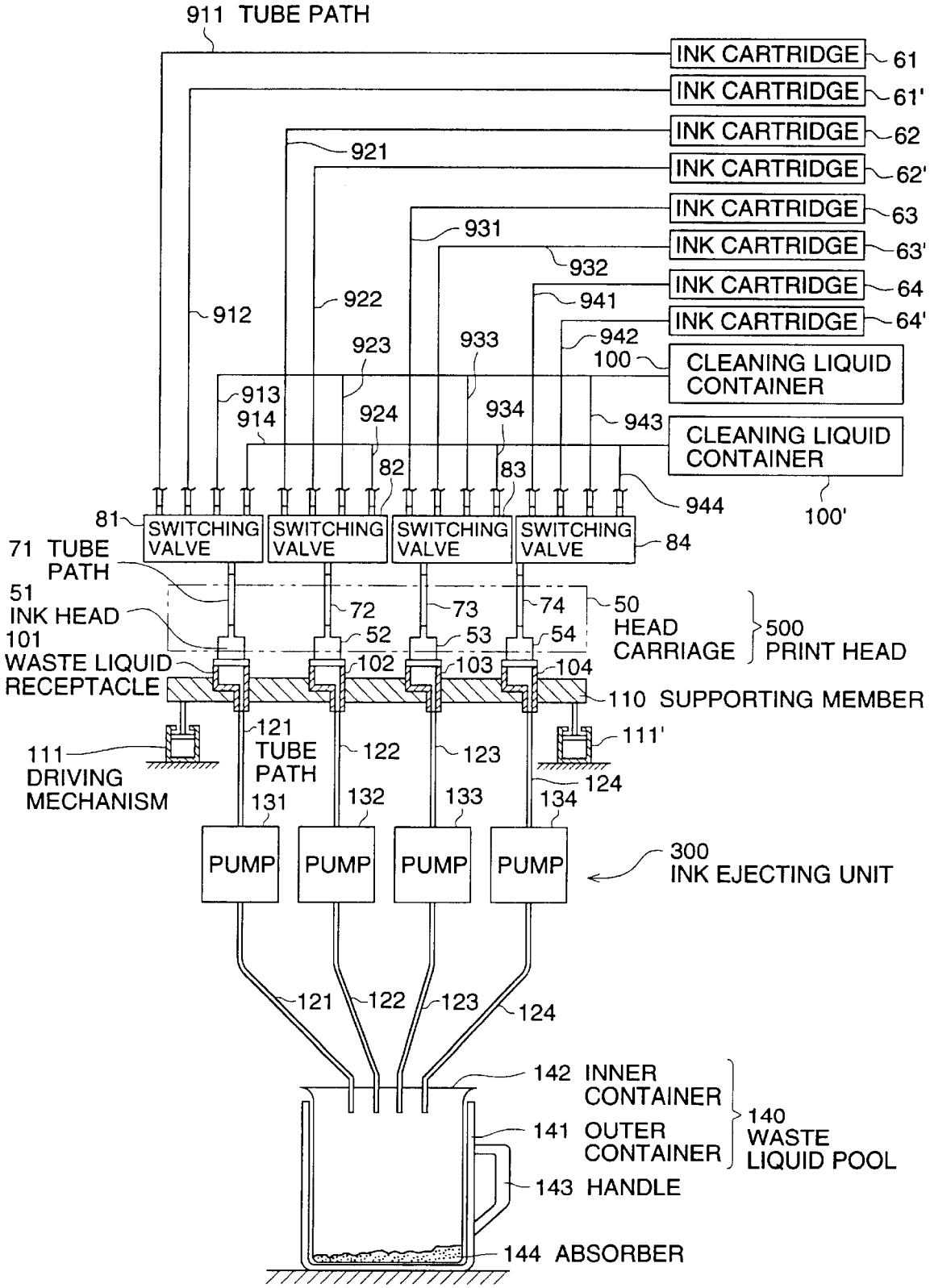
FIG. 4 is an illustrative structure diagram of an ink ejecting device in an example of the embodiment of the invention.

Plural ink heads are arranged so that ink is supplied to them from ink cartridge 60 through an ink supply system shown in FIG. 4. Ink is an example of the embodiment of the liquid in the invention. The ink cartridge 60 is mounted on the cover 002, and capable of being mounted on and dismounted from the cover 002.

Head carriage 50 is placed on unillustrated rails and is driven by an unillustrated driving section to jet ink onto a web conveyed by platen roller 30, while reciprocating (scanning) in the direction parallel to the shaft of the platen roller 30 for ink jet printing (textile printing).

The head carriage 50 has its home position in the inner space of cover 002 on which ink cartridge 60 is mounted. It is so arranged that the head carriage 50 is positioned at its home position to be on standby when no printing is being performed.

In order to discharge an ink or a cleaning liquid at the time of changing the ink or at the time of discharging the ink, an ink discharging device is provided in association with the head carriage 50 in the vicinity of its home position, as stated later. The ink discharging device is provided in the inner space of the cover 002 or of ink discharging section 003.

With the same manner, for the purpose of cleaning the ink head mounted on the head carriage 50, there is provided a head cleaning unit in the vicinity of the home position of the head carriage 50 as stated later. The head cleaning unit is provided in the inner space of the cover 002 or of head cleaning section 003.

As is shown with two-dot chain lines in FIG. 3, for example, a web is trained about the platen roller 30 in the direction from the rear side to the front side. At the lower portion on the front of the platen roller 30, there is provided guide 70 along which the web ejected out to the front side is guided downwards.

On the rear side of frame 001, there is provided control section 80 which controls rotation of the platen roller 30, scanning conducted by the head carriage 40, ink jetting of the ink head, and head cleaning operations of the head cleaning unit described later. The control section 80 is structured by the use of microprocessors, for example.

The control section 80 is arranged so that various commands can be given to it from operators through operation section 90. On the operation section 90, there are provided appropriate operation keys and display units which are not illustrated.

Next, a print head, an ink supply system and an ink jetting device will be explained. FIG. 4 shows illustrative structures of a print head, an ink supply system and an ink jetting device. As shown in the drawing, four ink heads 51–54 are arranged in a row on head carriage 50 to constitute print head 500.

Unillustrated driving circuits are mounted on the head carriage to correspond to the ink heads 51–54. Incidentally, the present drawing shows a condition wherein the head carriage 50 is in the vicinity of its home position.

The direction of arrangement of the ink heads 51–54 agrees with the scanning direction of the head carriage 50 (lateral direction in the drawing). Aforementioned four ink heads 51–54 correspond respectively to four primary colors of ink exemplified by cyan, magenta, yellow and black.

Each of the ink heads 51–54 has plural (for example, 64) nozzles. These nozzles are arranged in the direction perpendicular to the scanning direction of the head carriage 50 on a nozzle plane of the ink heads 51–54. A pitch of the arrangement is made to be one which enables dot resolution of 360 dpi to be realized.

A liquid is supplied to each of ink heads 51–54 through each of tube paths 71–74. Each of switching valves 81–84 is provided at the upstream side on each of the tube paths 71–74. In addition, an unillustrated damper or an unillustrated buffer which lessens a change of ink pressure caused by the movement of head carriage 50 is provided on the upper portion of print head 500.

To each of switching valves 8*x* (*x*: 1–4), there is connected one end of each of four tube paths 9*x*1–9*x*4. The other end of tube path 9*x*1 is connected to ink cartridge 6*x*. The other end of tube path 9*x*2 is connected to ink cartridge 6*x*'. A value of x corresponds to an ink color, and 1 corresponds to cyan, 2 corresponds to magenta, 3 corresponds to yellow and 4 corresponds to black, for example. Ink cartridges 6*x* and 6*x*' respectively correspond to cartridges respectively for two different types of ink each being of the same color.

To be concrete, ink cartridge 6*x* contains dispersive dye ink for polyester use, while ink cartridge 6*x*' contains reactive dye ink for cotton use, for example. An arrangement is made so that these ink are supplied to switching valves 8*x* respectively through tube paths 9*x*1 and 9*x*2.

The other end of tube path 9*x*3 is connected to cleaning liquid container 100. The other end of tube path 9*x*4 is connected to cleaning liquid container 100'. In the cleaning liquid container 100, there is contained a cleaning liquid composed mainly of water, for example. In the cleaning liquid container 100', there is contained a cleaning liquid composed mainly of organic solvent which solves dyes, for example. An arrange is made so that these cleaning liquids are supplied to switching valves 8*x* respectively through tube paths 9*x*3 and 9*x*4.

Incidentally, though ink cartridges 61–64 and 61'–64' and cleaning liquid containers 100 and 100' are shown to be arranged vertically for the purpose of drawing a figure, they are actually arranged to be in parallel with each other on the common horizontal plane which is lower than a nozzle plane of ink head 5*x* by a prescribed distance. Due to this, the prescribed negative pressure is impressed on ink head 5*x*.

Switching valve 8*x* switches tube paths 9*x*1–9*x*4, and connects one of them to tube path 7*x* under the control of control section 80. Owing to this, desired liquid can be supplied selectively to ink head 5*x*. The tube path 7*x*, switching valve 8*x* and tube paths 9*x*1–9*x*4 constitute an ink (and cleaning liquid) supply system.

Corresponding respectively to ink heads 51–54, there are provided waste liquid receptacles 101–104. The waste liquid receptacles 101–104 are made of rubber, for example, to be in a form of a cup. Namely, an upper portion of each of the waste liquid receptacles 101–104 is open, and the lower portion forms a bottom. An opening of each of the waste liquid receptacles 101–104 faces a nozzle plane of the ink heads 51 –54. A shape and dimensions of the opening conform to a shape and dimensions of the nozzle plane. Incidentally, each of the waste liquid receptacles 101–104 serves also as a cap to draw a liquid out of the nozzle, or to prevent drying of the tip of the nozzle.

The waste liquid receptacles 101–104 are supported by supporting member 110. The supporting member 110 is arranged so that it is driven by paired driving mechanisms 111 and 111' such as air cylinders, link mechanisms or spring mechanisms, for example, to move vertically. The non-moving side of each of the driving mechanisms 111 and 111' is fixed on frame 001. The operation side of each of the driving mechanisms 111 and 111' is controlled by control section 80.

The drawing shows the supporting member 110 which is moved to its uppermost position. Under this condition, each of the waste liquid receptacles 101–104 covers each of nozzle planes of ink heads 51–54. When the supporting member is in its lowermost position, each of the waste liquid receptacles 101–104 is away from each of nozzle planes of ink heads 51–54. Each of the waste liquid receptacles 101–104 has on its bottom a hole to which each of tube paths 121–124 is connected. Each of the tube paths 121–124 is led to waste liquid pool 140 through each of pumps 131–134. the waste liquid receptacles 101–104 has on its bottom a hole to which each of tube paths 121–124 is connected. Each of the tube paths 121–124 is led to waste liquid pool 140 through each of pumps 131–134. The waste liquid receptacles 101–104 through the pumps 131–134 constitute ink ejection unit 300. The pumps 131–134 are controlled by the control section 80.

The waste liquid pool 140 is structured to be a container whose top side forms an opening and lower side forms a bottom. The waste liquid pool 140 is arranged in the inside of ink ejecting section 003. The waste liquid pool 140 is of a double structure with outer container 141 and inner container 142. The outer container 141 has handle 143. The outer container 141 and the inner container 142 are structured to be capable of being separated from each other. The inner container 142 is of a disposable type. Absorbing agents 144 are contained in the inner container 142.

Next, ink switching operations will be explained. Operations described below are conducted under the control by control section 80. Ink switching is conducted when print head 500 is in the vicinity of its home position as shown in FIG. 4.

First of all, supporting member 110 is lifted upward by driving mechanisms 111 and 111', and each of the waste liquid receptacles 101–104 is caused to cover the corresponding nozzle plane of each of the ink heads 51–54.

Then, switching of switching valves 81–84 is conducted. Let it be assumed, for example, that ink is supplied to ink heads 51–54 from ink cartridges 61–64, and this is to be switched to the ink supply from ink cartridges 61'–64'.

First of all, switching valves 81–84 are switched to respectively select tube paths 913–943. The tube paths 913–943 represent tubes to supply cleaning liquid contained in cleaning liquid container 100, namely, the cleaning liquid which is mainly composed of water. Therefore, supply channels for cleaning liquid mainly composed of water are formed on ink heads 51–54.

Under the condition mentioned above, pumps 131–134 are driven so that ejection of ink may be conducted by an absorbing action of the pump. With this ink ejection, preceding ink remaining in the ink heads 51–54 and in tube paths 71–74 (and dampers) located respectively at the upstream side of the ink heads 51–54 can be ejected out to be replaced with cleaning liquid mainly composed of water.

Though contact between the remaining ink and a cleaning liquid takes place in the course of replacement, ink cohesion does not take place because the cleaning liquid is composed mainly of water. When this ejection of the cleaning liquid is continued for a while, the insides of the ink heads 51–54 and tube paths 71–74 are washed.

Ejected liquids (waste liquids) discharged from the ink heads 51–54 are received respectively by waste liquid receptacles 101–104. In waste liquid pool 140, waste liquid is absorbed by absorber 144. The absorber 144 which has absorbed the waste liquid becomes a gelatinous solid whose volume is mostly the same as that of the waste liquid. Due to this, the waste liquid becomes a solid having no fluidity and is stocked in the waste liquid pool 140.

After a cleaning liquid finishes running through for a prescribed period of time, switching valves 81–84 are switched to select tube paths 914–944. The tube paths 914–944 represent tubes to supply cleaning liquid contained in cleaning liquid container 100', namely, the cleaning liquid which is mainly composed of an organic solvent. Therefore, supply channels for cleaning liquid mainly composed of an organic solvent are formed on ink heads 51–54.

Under the condition mentioned above, pumps 131–134 are driven to eject a liquid so that a cleaning liquid composed mainly of an organic solvent may reach the tip of a nozzle in ink heads 51–54. Due to this, a liquid located at the downstream side of switching valve 8*x* is replaced with a cleaning liquid composed mainly of an organic solvent. After that, ejection is stopped to be left still for a period of about 5–30 minutes.

During the period of ejection and of leaving still, a cleaning liquid composed mainly of an organic solvent solves dispersive dyes which are stuck and solidified on an inner wall of a nozzle in ink heads 51–54 or in the tip of the nozzle and in tube paths 71–74 after operations for a long time. The longer the time of leaving still is, the higher an improvement of the degree of solution of the sticking dyes is.

Next, switching valves 81–84 are switched to respectively select tube paths 913–943. The tube paths 913–943 represent tubes to supply cleaning liquid contained in cleaning liquid container 100, namely, the cleaning liquid which is mainly composed of water. Therefore, supply channels for cleaning liquid mainly composed of water are formed again on ink heads 51–54.

Under the condition mentioned above, pumps 131–134 are driven to eject a liquid for a prescribed period of time. Due to this ejection, cleaning liquids each being composed mainly of an organic solvent which are remaining in ink heads 51–54 and in tube paths 71–74 (and dampers) located at the upstream side of the ink heads 51–54 are ejected. In this case, dyes solved in the cleaning liquid are also ejected together. Owing to this, substances causing clogging problems of ink heads 51–54 are removed.

When this ejection of a cleaning liquid is continued for a prescribed period of time, the cleaning liquids composed mainly of organic solvents are removed thoroughly from the inside of ink heads 51–54 and tube paths 71–74 to be replaced with cleaning liquids composed mainly of water.

Next, switching valves 81–84 are switched to respectively select tube paths 912–942. The tube paths 912–942 represent tubes to supply ink contained in ink cartridges 61'–64', namely reactive dye ink. Therefore, supply channels for supplying reactive dye ink are formed on ink heads 51–54.

Under the condition mentioned above, pumps 131–134 are driven to eject a liquid for a prescribed period of time. With this ejection, cleaning liquids remaining in ink heads 51–54 and in tube paths 71–74 located at the upstream side of the ink heads 51–54 are ejected to be replaced with fresh ink. Though contact between the remaining cleaning liquid and ink takes place in the course of replacement, cohesion of ink injected newly does not take place because the cleaning liquid is composed mainly of water. When this ejection of the cleaning liquid is continued for a prescribed period of time, replacement to fresh ink is made perfect.

Switching from dispersive dye ink to reactive dye ink is completed through the steps mentioned above. Though the foregoing represents an example of operations for switching from dispersive dye ink to reactive dye ink, switching from reactive dye ink to dispersive dye ink is conducted by tracing the above-mentioned sequence reversely. For example, switching of ink like that in the foregoing is conducted each time a type of a web of master roll 10 is changed.

Next, how to remove foreign materials contained in ink and cleaning liquid will be explained. Sucking (suction) by means of pump 13*x* is conducted also for the following objects, in addition to the suction required for the aforesaid switching of ink.

(1) To fill an ink supply system covering from an ink cartridge to an ink head with ink in the case of installation of a main device, and to eject air bubbles mixed in an ink supply system in replacement of ink cartridges.

(2) To solve the problem of clogging in a nozzle of an ink head.

(3) To remove air bubbles contained in an ink manifold.

(4) To remove fine air bubbles contained in a jetting channel (nozzle) located beyond the ink manifold.

After intensive studies, the inventors of the present invention found out that it is effective to change, depending on an object, the pressure caused by suction, for achieving the aforesaid object. Namely, for attaining the object (1), it is necessary to suck strongly and abruptly with great pressure for filling an ink supply system with ink as quickly as possible, and this is important, in particular, in the case of a large-sized ink jet printer wherein a tube path in the ink supply system is long. Also for attaining the object (2), it is necessary to penetrate clogging by sucking strongly and abruptly with great pressure.

When sucking strongly and abruptly for the objects of (1) and (2) as in the foregoing, air bubbles remaining in the ink supply system move together with ink, and are split into small air bubbles which enter the ink manifold of the ink head. The inventors of the invention found that small air bubbles which have entered the ink manifold can not be sucked effectively by the great pressure, but are sucked effectively by smaller pressure. Further, when air bubbles sucked from the ink manifold are made to be fine air bubbles in a jetting channel, they can be sucked effectively by still further smaller pressure. For the object of (3), therefore, the pressure which is smaller than that for the object (1) or (2) is used for sucking, while for the object of (4), extremely small pressure is used for sucking.

Figure 5:
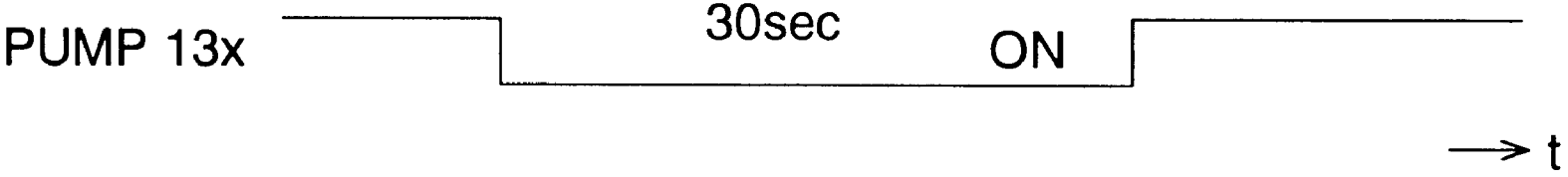
FIG. 5 is a time chart of operations of a pump in the course of ink ejection on an apparatus in an example of the embodiment of the invention.

Each of FIGS. 5–9 shows a time chart of an example of the control of pump 13*x*. FIG. 5 shows an occasion of sucking for the object of (1), namely an occasion of initial running of ink wherein pump 13*x* is operated continuously for 30 seconds for sucking ink head 5*x*. Due to this, strong suction is carried out by the great pressure as shown in FIG. 10(*a*). Suction of this kind is conducted in succession by pumps 131–134, and thereby, ink heads 51–54 are filled with ink.

Incidentally, pump 13*x* is provided with an unillustrated pressure relief means which is communicated with atmospheric pressure, and suction pressure of ink head 5*x* is restored to atmospheric pressure with a certain damping time constant, after the pump 13*x* stops. A pressure relief opening of the pressure relief means is arranged to be capable of being opened, closed and adjusted, and the damping time constant for increase and decrease of pressure is made to be capable of being adjusted.

Figure 6:
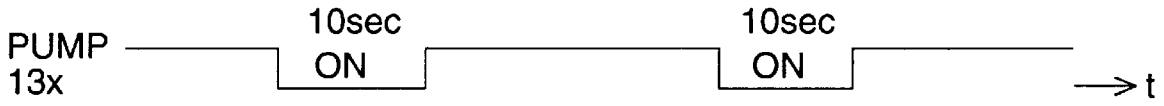
FIG. 6 is a time chart of operations of a pump in the course of ink ejection on an apparatus in an example of the embodiment of the invention.

FIG. 6 shows an occasion to conduct suction for the object of (2), namely, an occasion to penetrate clogging of a nozzle, wherein pump 13*x* is operated for 10 seconds intermittently at regular intervals of 20 seconds for suction of ink head 5*x*. Due to this, strong suction is conducted by great pressure in the same manner as in (1). Suction of this kind is conducted in succession by pumps 131–134, and thereby, clogging in each of ink heads 51–54 is penetrated.

Figure 7:
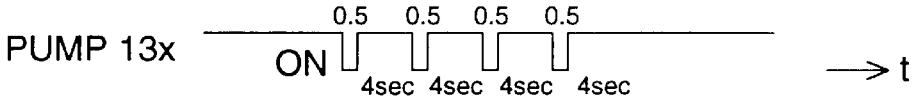
FIG. 7 is a time chart of operations of a pump in the course of ink ejection on an apparatus in an example of the embodiment of the invention.

FIG. 7 shows an occasion to conduct suction for the object of (3), namely, an occasion to remove small air bubbles in an ink manifold, wherein pump 13*x* is operated for 5 seconds intermittently at regular intervals of 4 seconds for suction of ink head 5*x*. Due to this, weak suction is conducted by small pressure as shown in FIG. 10(*b*), for example. Suction of this kind is conducted in succession by pumps 131–134, and thereby, small air bubbles in the ink manifold of ink heads 51–54 are removed.

Figure 8:
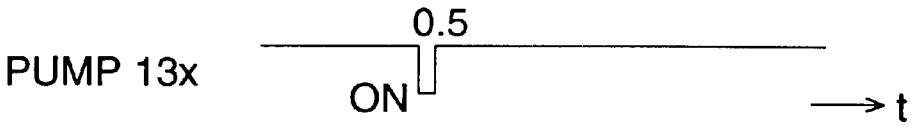
FIG. 8 is a time chart of operations of a pump in the course of ink ejection on an apparatus in an example of the embodiment of the invention.

FIG. 8 shows an occasion to conduct suction for the object of (4), namely, an occasion to remove fine air bubbles contained in a jetting channel, wherein pump 13*x* is operated for 5 seconds once for suction of ink head 5*x*. Due to this, small pressure is applied once as shown in FIG. 10(*c*), for example. Faint suction is conducted when suction is carried out once by small pressure. Faint suction of this kind is conducted in succession by pumps 131–134, and thereby, fine air bubbles in the jetting channel of ink heads 51–54 are removed.

Figure 9:
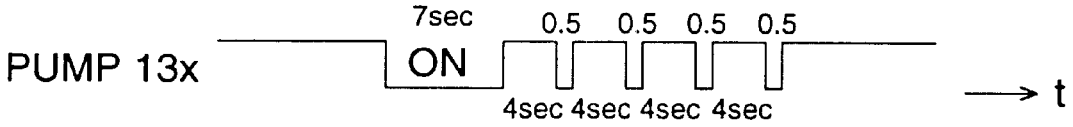
FIG. 9 is a time chart of operations of a pump in the course of ink ejection on an apparatus in an example of the embodiment of the invention.
Figure 10:
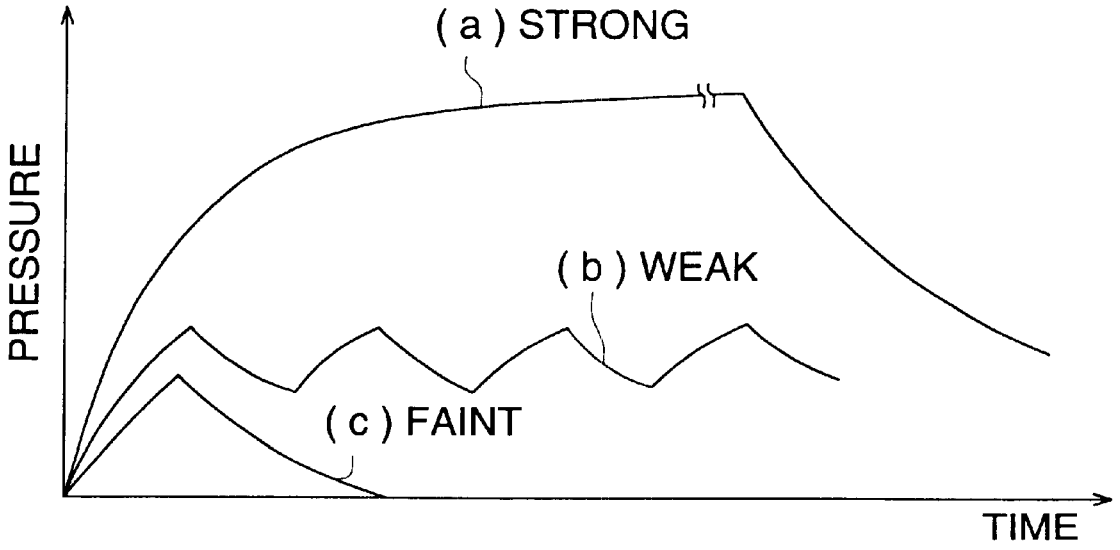
FIG. 10 is a graph showing pressure change in the course of ink ejection on an apparatus in an example of the embodiment of the invention.

FIG. 9 shows an occasion wherein aforesaid suctions are combined to be conducted, wherein, for example, suction for 0.5 seconds is repeated for several times at regular intervals of 4 seconds after conducting suction for 7 seconds, so that suction wherein strong suction and weak suction are combined may be conducted. When replacement of ink heads 51–54 is conducted, it is preferable from the viewpoint of effective removal of air bubbles that the above-mentioned suction wherein strong suction and weak suction are combined is conducted after 20 seconds from the strong suction shown in FIG. 5. Also, in the case the strong suction is conducted with a high pressure for the objects (1) and (2) stated above, it may be preferable to conduct the weak suction with a low pressure, because small are bubbles or fine are bubbles caused by the strong suction with a high pressure can be removed.

It is preferable, from the viewpoint of obtaining variable pressure with a pump whose sucking force is constant, that the operation time of pump 13*x* is controlled to be on and off intermittently (PWM control: pulse width modulation control). Incidentally, it is naturally possible to adjust sucking force by controlling the speed of operations such as the speed of revolution, for example, of pump 13*x* which operates continuously, in place of, or in addition to the control of operation time.

It is also possible to conduct strong suction through continuous operations of pump 13*x* and to conduct weak (including faint) suction through intermittent operations, or it is possible, on the contrary, to conduct strong suction through intermittent operations of pump 13*x* and to conduct weak suction through continuous operations of pump 13*x*.

Though the foregoing represents an example wherein a pressure is generated by suction, the pressure may also be generated by pressurization. In that case, a pressurizing means such as a pump naturally needs to be positioned at the uppermost portion in a stream of an ink supply system.

Further, in the above embodiment, in consideration of the kind of ink and the structure of the apparatus including an ink head, the optimum timing of a pumping action may be set and memorized in a memory means in the apparatus. However, it may be also possible that a pressure sensor is provided between the pump 13*x* and the ink head and the pump 13*x* is controlled in accordance with a signal representing a pressure detected by the pressure sensor by a feed-back control.

Next, head cleaning is explained.

Cleaning of the ink head is conducted by control operations of the control section 80 based on commands by the operator. Under the control made by the control section 80, head cleaning is carried out, following ink jetting from an ink head conducted before the operation of the unit, for example, and is carried out also in the course of the operation at regular intervals of prescribed time period (for example, 30 minutes). In addition, the head cleaning can be carried out at any time based on a command of the operator.

Figure 11:
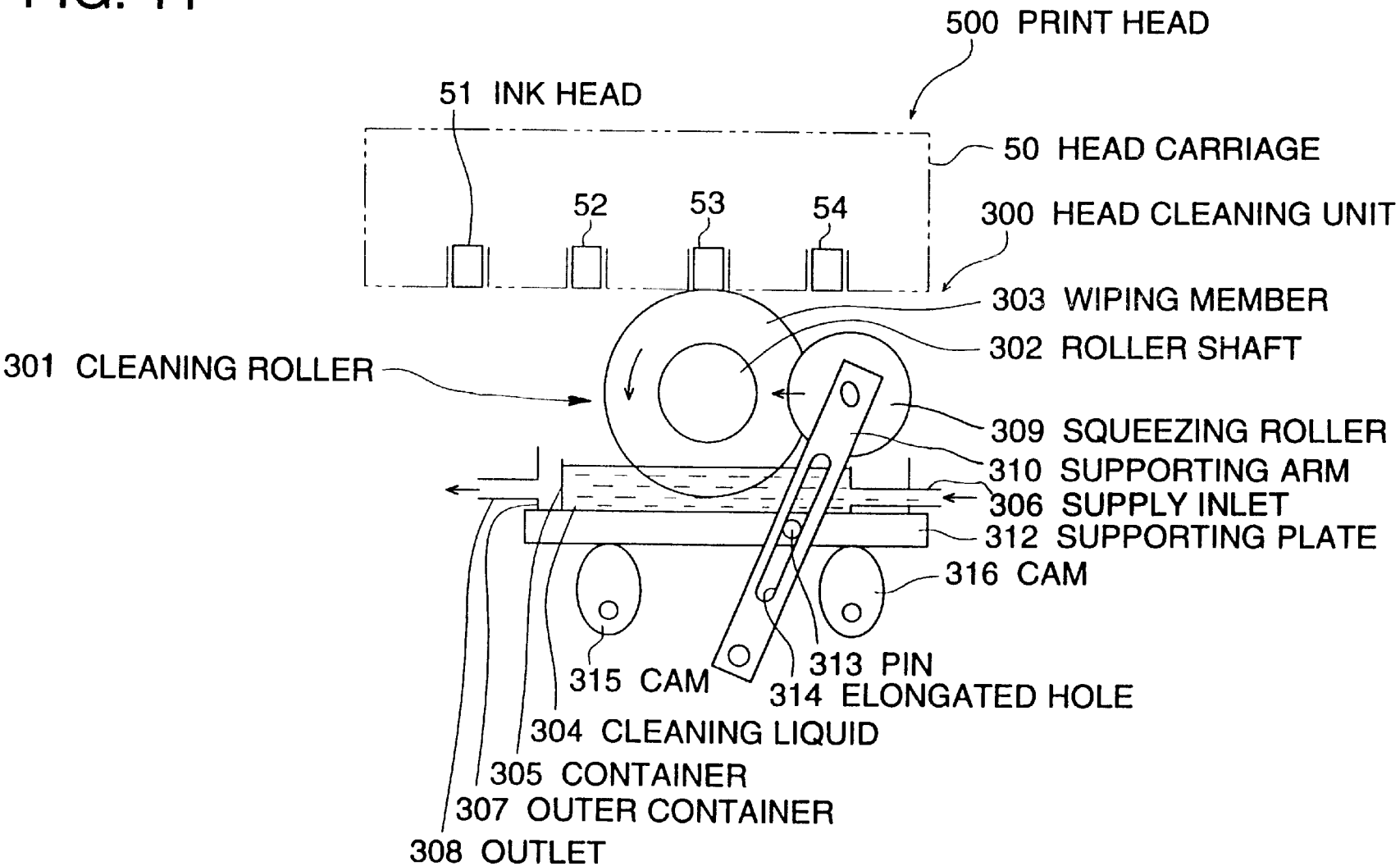
FIG. 11 is an illustrative structure diagram of a head cleaning unit on an apparatus in an example of the embodiment of the invention.

The print head and the head cleaning unit will be explained. FIG. 11 shows illustrative structure of the print head and the head cleaning unit. As is shown in the drawing, four ink heads 51–54, for example, are arranged in a line to be mounted on head carriage 50 to constitute print head 500. Unillustrated driving circuits corresponding to the ink heads 51–54 are mounted on the head carriage 50.

The direction of arrangement of the ink heads 51–54 agrees with the scanning direction of the head carriage 50, namely with the lateral direction in FIG. 11. Four ink heads 51–54 respectively correspond to the four primary colors of ink, for example, to cyan, magenta, yellow and black.

Each of the ink heads 51–54 has plural nozzles (for example, 64 nozzles) which are not shown. These nozzles are arranged in the direction perpendicular to the scanning direction of head carriage 50 on the plane of nozzles of the ink heads 51–54. The pitch of the arrangement is made to be one which makes the dot resolution of 360 dpi, for example, to be possible.

The ink heads 51–54 are arranged so that ink may be supplied to each of them through unillustrated pipe lines. Though there is no illustration, on the upper portion of print head 500, there sometimes is provided a damper or a buffer which moderates fluctuation of ink pressure caused by movement of head carriage 50.

The ink jetting plane of the ink heads 51–54 is constituted to be cleaned by cleaning roller 301. Cleaning roller 301 is an example of the embodiment of a wiping means in the invention. The cleaning roller 301 is composed of roller shaft 302 and cylindrical wiping member 303 which is mounted concentrically on the roller shaft 302. The wiping member 303 is an example of the embodiment of a wiping member in the invention. The wiping member 303 has its length which is greater than that of the ink heads 51–54 in the axial direction of the cleaning roller 301. With regard to the cleaning roller 301, its structure wherein at least wiping member 303 is replaceable is preferable in terms of easy measures for consumption of the wiping member 303.

The wiping member 303 is made of sponge-like soft porous material. As a porous material like that, a porous plastic polymer material having continuing air bubbles, for example, is used. A porous material whose average porosity is 70% or more and average blow hole diameter measured by Porosimeter is not more than 400 $\mu$m is preferable on the point of excellent cleaning. Here, the sample volume (a net volume) is obtained from a low of gas of Voil for pressure change which is one of a gas replacing method, then the average porosity can be obtained from the ratio of the sample volume to an apparent volume of the sample. More concretely, the net volume is measured by AccuPyc 1330 manufactured by Micromeritics, the average porosity is obtained by the following formula:

$$\text{The average porosity}=((\text{apparent volume})\times(\text{net volume}))/(\text{apparent volume})\times 100$$

Further, the bubble diameters of several pieces (5–10 pieces, depending on the porous material) sampled in the order from the larger size are measured with a measure printed on a photograph and the average value is obtained from the bubble diametersa and is used as the average bubble diameter.

As a concrete material, BELL-ETA (trade name, Kanebo Corp.) and RUBYCELL P ROLL (trade name, Toyo Polymer Corp.) offer cleaning effect which is especially excellent. They are also preferable as a cleaning member on the point that they do not generate dust such as abrasion powder, namely, they do not have self-staining property. It is preferable for conducting excellent cleaning that an outside diameter of the wiping member 303 is 5–50 mm, and an inside diameter thereof is 1–40 mm depending on the size of ink heads 51–54.

Cleaning roller 301 is rotatably supported by an unillustrated supporting member, and is driven by an unillustrated driving section to rotate counterclockwise in the drawing. The cleaning roller 301 is positioned in its vertical direction in the drawing so that the height of its outer circumference may be greater than that of the ink jetting plane of the ink heads 51–54. Due to this, when the cleaning roller 301 rotates, it can wipe the ink jetting plane of the ink head. The drawing shows how the cleaning roller 301 wipes the ink jetting plane of the ink head 53. Incidentally, it is preferable that an amount by which the height of the outer circumference of the cleaning roller 301 exceeds that of the ink jetting plane of the ink heads 51–54 is established appropriately within a range that is not larger than 60% of the wall thickness of wiping member 303, in particular, does not exceed half of the wall thickness of wiping member 303. Further, from the relationship to the deformed amount for the squeezing roller 309, it may be preferable that the above range is 30% to 60% of the wall thickness of wiping member 303, and more preferable that the above range is 40% to 50% of the wall thickness of wiping member 303.

The cleaning roller 301 is arranged so that its side (lower portion) that is opposite to the side which is in contact with the ink heads is immersed in cleaning liquid 304. As cleaning liquid 304, pure water, for example, is used. For enhancing the cleaning power, it is preferable to use a liquid having the similar property as that of ink in the ink heads 51–54, it is more preferable to use a liquid having the same reagent as that of ink in the ink heads 51–54 on the point to improve similarity of ink properties, although surface active agents may be added appropriately. Here, the liquid having the similar property as that of ink is a liquid not to cause condensation and not to change the characteristic of ink such as a viscosity or a surface tension if the liquid is mixed with the ink. As a liquid like that, an ink liquid containing no dyes or no pigments, for example, is preferable. Further, a cleaning liquid containing antiseptic substances is preferable on the point of long term preservation of the cleaning liquid.

Cleaning liquid 304 is contained in container 305. The container 305 is an example of the embodiment of a cleaning liquid supply means in the invention. It is so arranged that a cleaning liquid is supplied to the container 305 from an unillustrated cleaning liquid reservoir section through supply inlet 306. Outside the container 305, there is provided outer container 307 which receives used cleaning liquid overflowing the container 305 after replenishment of a cleaning liquid, and ejects it to an unillustrated waste liquid reservoir section through outlet 308. The outer container 307 is an example of the embodiment of a cleaning liquid collecting means in the invention. The container 305 and the outer container 307 are provided on supporting plate 312. On the supporting plate 312, there is also mounted an unillustrated supporting mechanism which supports the cleaning roller 301.

When the bottom portion of the cleaning roller 301 is immersed in cleaning liquid 304, wiping member 303 made of porous material absorbs the cleaning liquid 304. On the downstream side in the rotary movement of the wiping member 303 which has absorbed the cleaning liquid 304, squeezing roller 309 is in pressure contact with the wiping member 303 in the radial direction, an impregnation amount adjusting is an example of the embodiment of an impregnation amount adjusting means or an impregnation amount adjusting member in the invention. A diameter of the squeezing roller 309 is made to be smaller than that of the cleaning roller 301.

The squeezing roller 309 is made of a material that is harder than the wiping member 303 represented, for example, by hard rubber or stainless steel. The squeezing roller 309 is supported rotatably on one end of supporting arm 310. A middle portion of the supporting arm 310 is engaged with pin 313 provided on supporting plate 312 through elongated hole 314 formed at the middle portion of the supporting arm. The other end of the supporting arm 310 is arranged to receive adjusting force from an unillustrated squeezing amount adjusting unit. The squeezing amount adjusting unit is controlled by control section 80.

This adjusting force makes the squeezing roller 309 to be brought into pressure contact with the wiping member 303 in a way that the squeezing roller 309 is pushed into the wiping member 303 to an appropriate depth. With regard to this depth of the intrusion, it is preferable for an appropriate squeezing amount of a cleaning liquid that the depth is adjusted within a range from 0.5 mm to 60% of a wall thickness of the wiping member 303, in particular, more preferable that the depth is adjusted within a range from 0.5 mm to 50% of a wall thickness of the wiping member 303. Incidentally, it is also possible to use a fence-shaped squeezing plate in place of the squeezing roller 309. Those including the cleaning roller 301 up to the supporting plate 312 stated above, constitute head cleaning unit 300.

Due to the squeezing action caused by pressure contact of the squeezing roller 309, a part of cleaning liquid 304 absorbed in the wiping member 303 is squeezed out. An impregnation amount of a cleaning liquid in the wiping member 303 is made to be appropriate by the squeezing out stated above, thus, the ink jetting plane of ink head 53 is wiped by the wiping member 303 impregnated with appropriate quantity of cleaning liquid.

The wiping member 303 which has wiped the ink jetting plane and has absorbed stains is then immersed in cleaning liquid 304 to throw stains and to absorb a cleaning liquid. Then, it is squeezed by the squeezing roller 309 so that the prescribed amount of cleaning liquid is squeezed out, and wipes the ink jetting plane again. When the aforesaid operations are repeated continuously, the ink jetting plane of the ink head 53 is cleaned.

Incidentally, by selecting material, porosity and a blow hole diameter of wiping member 303 appropriately, and by establishing rotating speed of cleaning roller 301 appropriately, it is possible to make the impregnation amount of cleaning liquid in the wiping member 303 to be appropriate without needing squeezing roller 309, and in such case, the squeezing roller 309 can be omitted.

In a printing apparatus for a web, when a dispersion ink is used, a pigment tends to stick to the surrounding of a nozzle. Therefore, cleaning of an ink jetting plane is especially effective for maintenance of print quality. Further, it is preferable for enhancement of the cleaning effect that the ink jetting plane and cleaning roller 301 are moved relatively. The rotating speed of the cleaning roller 301 for that purpose is preferably selected appropriately within a range of 1–300 rpm depending on the diameter of the cleaning roller. It is preferable for appropriate cleaning that the peripheral speed of the cleaning roller 301, in that case, is made to be 800 mm/s or less, and preferably to be 5–55 mm/s.

Cleaning of an ink jetting plane can be conducted either when making head carriage 50 to travel or when making head cleaning unit 300 to move. Due to this, ink jetting planes of ink heads 51–54 are cleaned in succession. In that case, it is preferable for appropriate cleaning that the relative moving speed between head carriage 50 and head cleaning unit 300 is selected appropriately to be within a range of 1–100 mm/s.

From the foregoing, the relative moving speed between an ink jetting plane and cleaning roller 301 which is not more than 900 mm/s is preferable. By adjusting the relative moving speed within this range, abrasion on the ink jetting plane and splashing of cleaning liquid can be avoided. Incidentally, it is preferable for enhancing cleaning effect that the direction of relative traveling is made to be the direction which is against to the direction of rotation of cleaning roller 301. Further, cleaning can naturally be conducted in the way wherein head carriage 50 or head cleaning unit 300 is stopped at the position where each ink head comes in contact with cleaning roller 301 to make relative traveling intermittently.

In the head cleaning unit 300, when cleaning roller 301 is rotated, fresh roller surface constantly carries away stains on the ink jetting plane, and therefore, stain-wiping power is raised by far, compared with one to wipe constantly with the same surface of a blade, like the conventional cleaning blade.

In addition, since the ink jetting plane is wiped by an outer circumferential surface of cleaning roller 301 which constantly moves in a cycle with rotation of the cleaning roller 301, there is an advantage that abrasion of a wiping member per the same wiping area is much less, compared with one to wipe constantly with the same surface of a blade, like the conventional cleaning blade. It is therefore possible to reduce sharply the frequency of replacement of wiping member 303 caused by abrasion.

Further, by selecting the speed of rotation of cleaning roller 301, optimum cleaning conditions can easily be realized. Namely, not only the traveling speed of head carriage 50 but also the speed of rotation of cleaning roller 301 can be selected. Therefore, the degree of freedom for adjustment of cleaning conditions is enhanced, resulting in easy implementation of optimum cleaning.

Furthermore, by combining adjustment of the amount of cleaning liquid squeezed by squeezing roller 309, the degree of freedom for adjustment of cleaning conditions can be raised by one step, which makes the optimum cleaning to be more easy. There is also an advantage that utilization efficiency of cleaning liquid 304 is high because squeezed cleaning liquid 304 is returned to container 305 to be used again.

Figure 12:
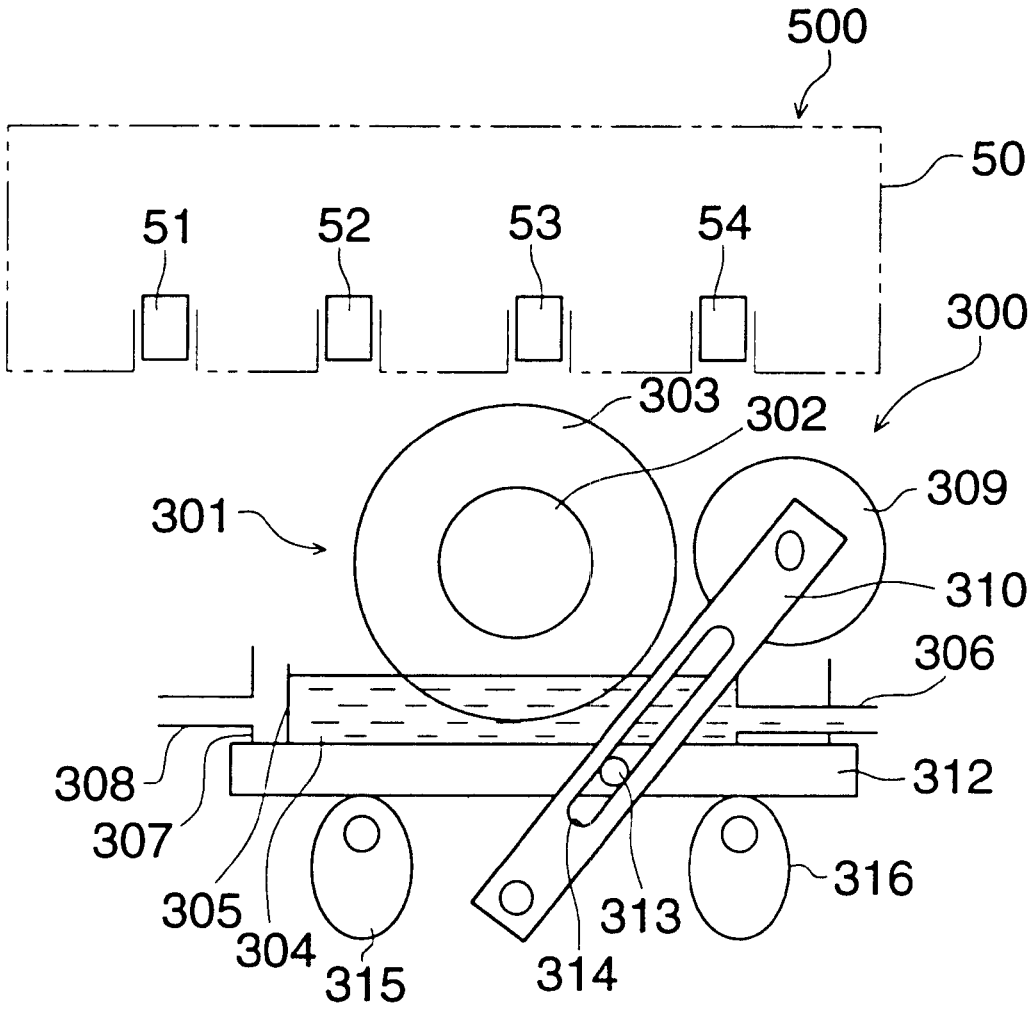
FIG. 12 is an illustrative structure diagram of a head cleaning unit on an apparatus in an example of the embodiment of the invention.

Supporting plate 312 is arranged so that its height may be adjusted vertically by paired cams 315 and 316 Due to this, head cleaning unit 300 is moved up or down collectively The cams 315 and 316 represent an example of the embodiment of a shifting means in the invention. FIG. 11 shows the state where the head cleaning unit is elevated. FIG. 12 shows the state where the head cleaning unit is lowered, in which cleaning roller 301 is away from an ink head. This state is kept to stand by when no cleaning is conducted. In this case, it is preferable for avoiding useless deformation of wiping member 303 caused by the pressure contact that engagement of pin 313 with elongated hole 314 is utilized to swivel supporting arm 310 and thereby pressure contact of squeezing roller 309 with wiping member 303 is released. The mechanism to swivel the supporting arm 310 is an example of the embodiment of a shifting means in the invention.

Incidentally, with regard to the rotation of cams 315 and 316, it is also possible to employ an arrangement wherein cams 315 and 316 and cleaning roller 301 share a common driving source which has a clutch mechanism, and cleaning roller 301 is driven by the rotation in one direction of the driving source and the cams 315 and 316 are driven the rotation in the other direction.

Incidentally, it is also possible to employ an arrangement wherein head cleaning unit 300 is moved in the direction perpendicular to the paper in FIG. 11 in place of vertical movement so that cleaning roller 301 is put out of the traveling path of head carriage 50 and thereby it is separated from the ink heads.

Figure 13:
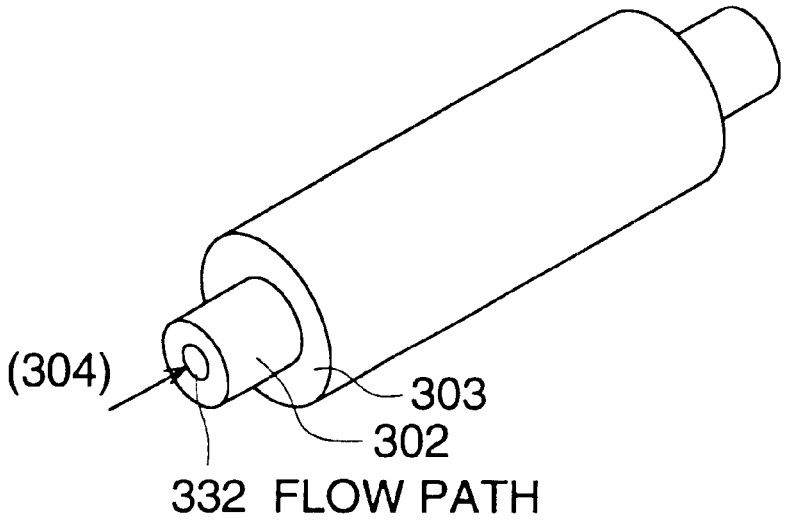
FIGS. 13(*a*) and 13(*b*) are illustrative structure diagrams of an example of a cleaning liquid supply mechanism on an apparatus in an example of the embodiment of the invention.
Figure 13:
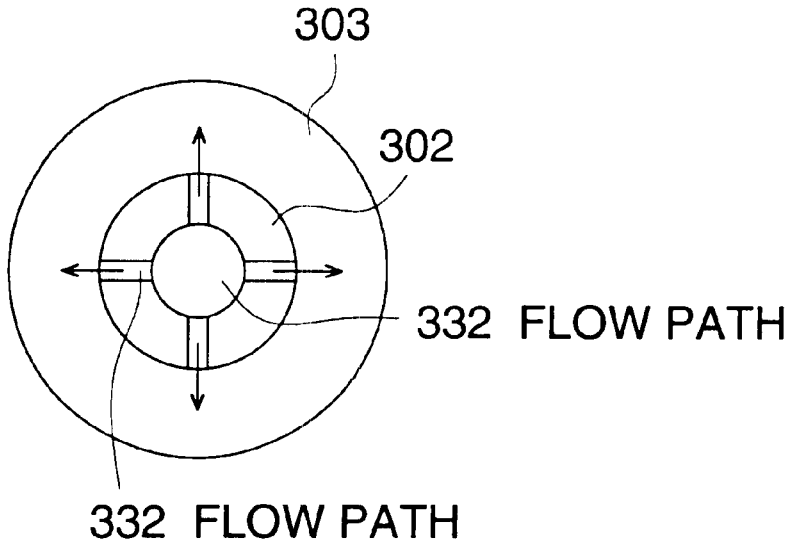
Figure 14:
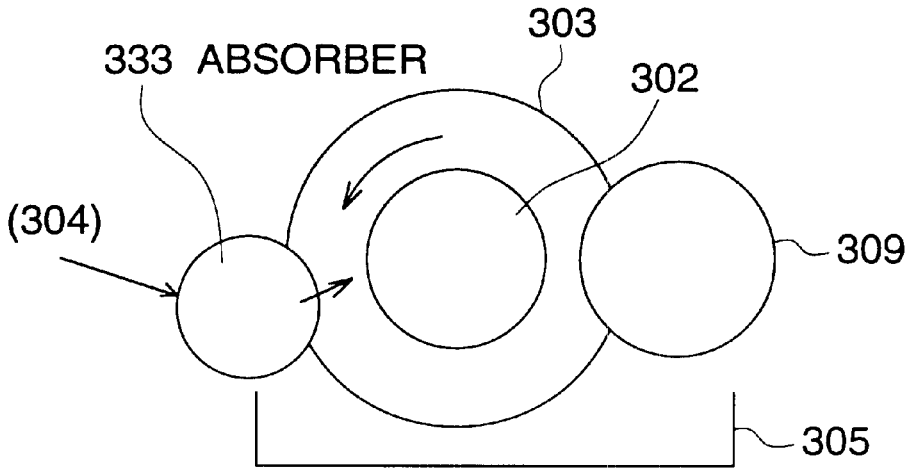
FIG. 14 is an illustrative structure diagram of an example of a cleaning liquid supply mechanism on an apparatus in an example of the embodiment of the invention.
Figure 15:
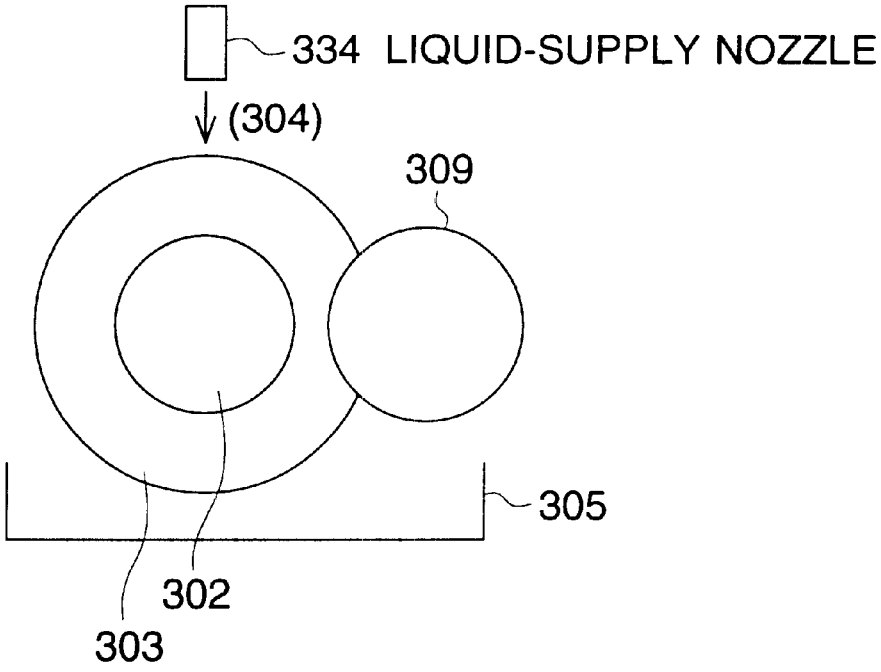
FIG. 15 is an illustrative structure diagram of an example of a cleaning liquid supply mechanism on an apparatus in an example of the embodiment of the invention.

With regard to a method of supplying cleaning liquid 304 to wiping member 303 of cleaning roller 301, it is also possible to employ a method wherein flow path 332 is provided in roller shaft 302, and cleaning liquid 304 is supplied to wiping member 303 from its inside through the flow path 332, as shown in FIG. 13, for example. Or, it is also possible, for example, to make absorber 333 to absorb cleaning liquid 304 temporarily, and then to transfer the cleaning liquid to wiping member 303, as shown in FIG. 14. Or, it is also possible, for example, to supply cleaning liquid 304 to wiping member 303 from liquid-supply nozzle 334, as shown in FIG. 14. These methods are all preferable on the point that a cleaning liquid container in which wiping member 303 is immersed is not needed.

Figure 16:
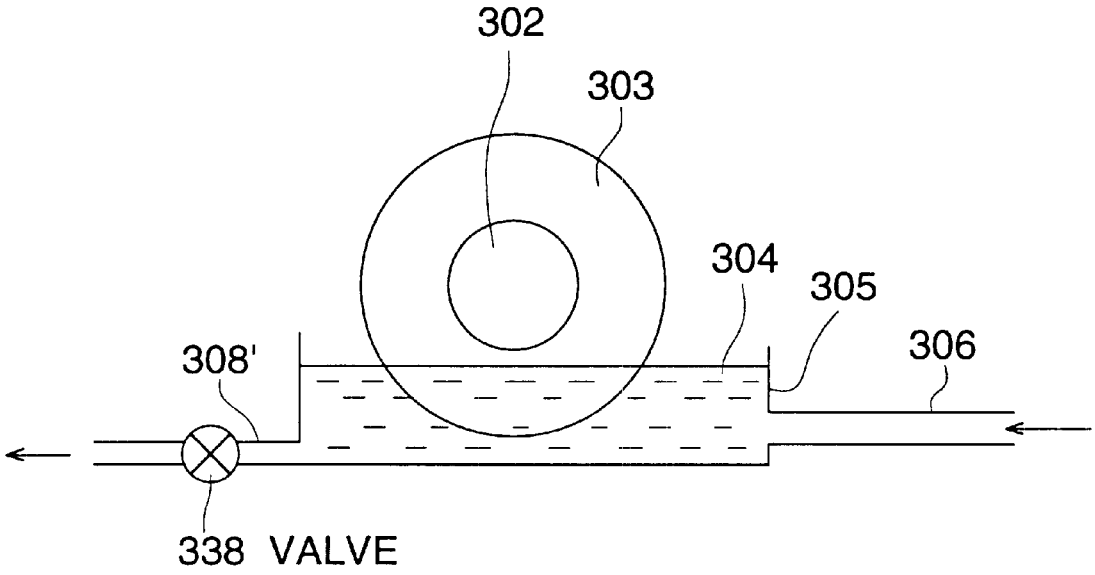
FIG. 16 is an illustrative structure diagram of an example of a cleaning liquid collecting mechanism on an apparatus in an example of the embodiment of the invention.

With regard to a method to discharge a used cleaning liquid, one way, for example, is to discharge it through outlet 308' provided at the deepest position of container 305 as shown in FIG. 16. This method is preferable on the point that the used cleaning liquid 304 is discharged together with smudges deposited on the bottom of the container 305. Incidentally, discharging is conducted by opening valve 338 on a timely basis.

Also, while the ink jetting surfaces of the ink heads 51–54 are cleaned by the cleaning roller 301, by making the pressure in the ink head (nozzle) higher, the reverse flow that the cleaning liquid absorbed in the wiping member 303 of the cleaning roller 301 flows reversely from the ink jetting port into the ink head (nozzle) can be avoided. Further, the de-cap can be avoided. Especially, while the ink jetting section comes in contact with the cleaning roller 301, it is preferable to make the pressure in the ink head (nozzle) higher. For such a purpose, for example, while the ink jetting surfaces of the ink heads 51–54 are cleaned by the cleaning roller 301, especially, while the ink jetting section comes in contact with the cleaning roller 301, it may be preferable that the control section 80 controls the ink head so as to jet the ink from the ink jetting section.

Figure 17:
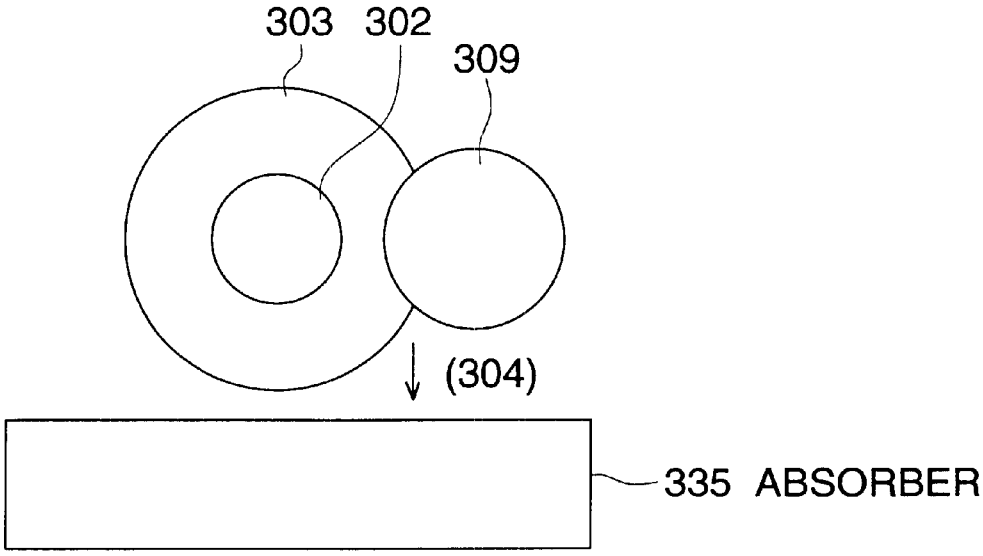
FIG. 17 is an illustrative structure diagram of an example of a cleaning liquid collecting mechanism on an apparatus in an example of the embodiment of the invention.

A cleaning liquid squeezed out of wiping member 303 by squeezing roller 309 can also be absorbed by absorber 335 as shown in FIG. 17, for example. The absorber 335 is made, for example, of a porous material. Or, an absorbing agent made of a polymer which is highly water-absorbent can also be used. These substances are preferable on the point that the cleaning liquid 304 can be subjected to disposal after its fluidity is eliminated.

Figure 18:
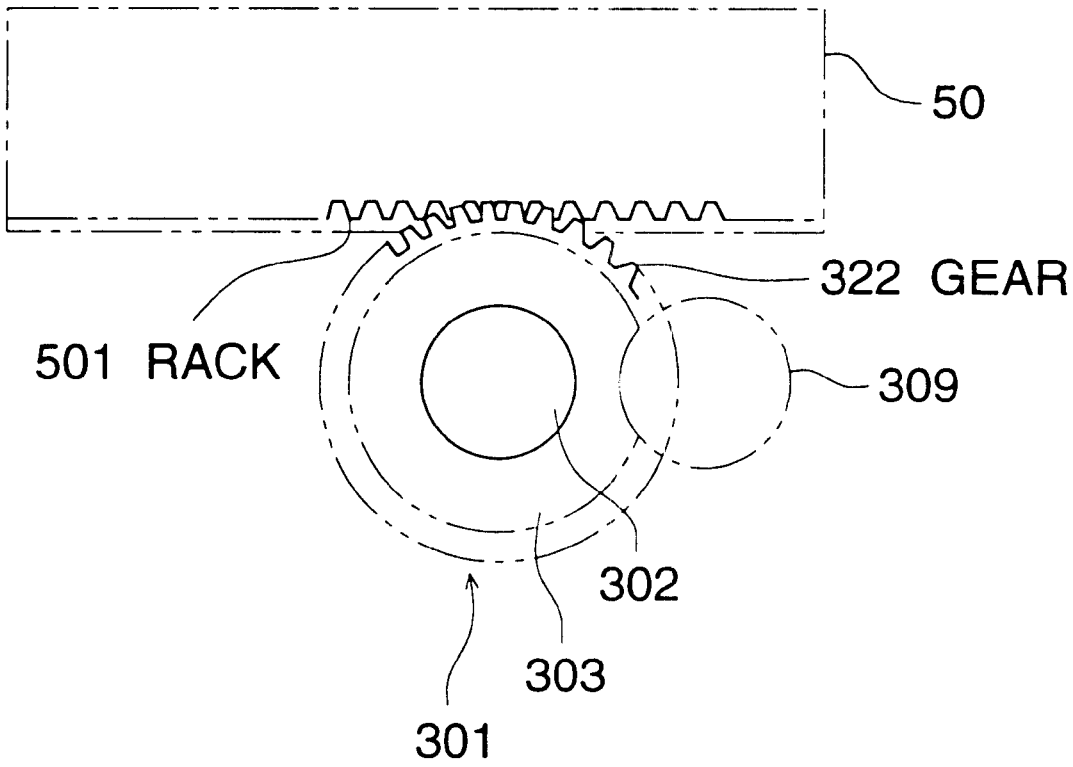
FIG. 18 is an illustrative structure diagram of an example of cleaning roller driving mechanism on an apparatus in an example of the embodiment of the invention.

Driving power for rotating cleaning roller 301, for example, can also be obtained by utilizing the traveling of head carriage 50 as shown in FIG. 18. Namely, gear 322 is provided coaxially on roller shaft 302 of the cleaning roller 301 as shown in FIG. 11, and rack 501 which engages with the gear 322 is provided on the head carriage 50 so that the cleaning roller 301 is rotated when the head carriage 50 travels, and thereby an ink jetting plane is wiped by wiping member 303. This is preferable on the point that a motor representing a driving source is shared, and thereby the number of parts to be used is reduced. Incidentally, it is preferable in terms of enhancing wiping capability of wiping member 303 that another gear is provided between the rack 501 and gear 322, and thereby, the number of rotations of the cleaning roller 301 per a length of movement of the head carriage 50 is increased, or the direction of rotation of the cleaning roller 301 is made to be opposite to the traveling direction of the head carriage 50.

As described above, with the invention of Item 1, since the liquid ejecting means conducts liquid ejection which is in conformity with properties of foreign substances, by varying the pressure in plural steps, the liquid jetting apparatus to remove appropriately foreign materials contained in the liquid can be realized.

With the invention of Item 2, the pressure releasing means can give the time constant for increase or decrease of pressure.

With the invention of Item 3, the pressure releasing means opens or closes the pressure releasing gateway so that the time constant can be adjusted.

With the invention of Item 4, the liquid ejecting means can conduct liquid ejection which is in conformity with properties of foreign substances, by varying the pressure in two steps.

With the invention of Item 5, the liquid ejecting means can conduct liquid ejection which is in conformity with properties of foreign substances, by varying the pressure in three steps.

With the invention of Item 6, the liquid ejecting means can use pressures in three steps each in its proper way, for initial running of a liquid and/or unclogging of the liquid jetting section, removing air bubbles in the liquid manifold and for removing air bubbles in the jetting channel.

With the invention of Item 7, the liquid ejecting means can adjust the pressure by means of a pulse width of intermittent operations of a pump.

With the invention of Item 8, the liquid ejecting means can adjust the pressure through the speed of a continuous operation of a pump.

With the invention of Item 9, the liquid ejecting means can adjust the relatively high pressure by means of a pulse width of intermittent operations of a pump and adjusts the relatively low pressure by means of the speed of a continuous operation of a pump.

With the invention of Item 10, the liquid ejecting means can adjust the relatively high pressure by means of the speed of a continuous operation of a pump and adjusts the relatively low pressure by means of a pulse width of intermittent operations of a pump.

With the invention of Item 11, the liquid ejecting means imposes pressures in plural steps on a liquid so that a foreign material can be removed appropriately.

With the invention of Item 12, the liquid ejecting means imposes pressures in plural steps on a liquid through pressurization so that a foreign material can be removed appropriately.

With the invention of Item 13, since a cleaning liquid impregnated wiping means is rotated to wipe the liquid jetting section and thereby to clean it, the liquid jetting apparatus to conduct appropriately cleaning for the liquid jetting section can be realized.

With the invention of Item 14, since the outer circumferential surface of the wiping member stated above moves relatively to the liquid jetting section in the course of wiping, the cleaning for the liquid jetting section can conduct appropriately.

With the invention of Item 15, appropriate cleaning can be conducted when the speed of relative movement is not more than 900 mm/s.

With the invention of Item 16, when using a wiping member whose outside diameter is 5–50 mm and inside diameter is 1–40 mm, an appropriate liquid-impregnating characteristic and wiping property can be materialized.

With the invention of Item 17, an appropriate liquid-impregnating characteristic and wiping property can be materialized by a wiping member employing a porous material having continuing air bubbles.

With the invention of Item 18, an appropriate liquid-impregnating characteristic or liquid-absorbing characteristic and wiping property can materialized when using a porous material having an average porosity of 70% or more.

With the invention of Item 19, an appropriate liquid-impregnating characteristic and wiping property can be materialized when a porous material having an average blow hole diameter of not more than 400 $\mu$m is used.

With the invention of Item 20, the fluctuating means can bring the wiping member into contact with the liquid jetting section in the case of cleaning, and can separate the wiping member from the liquid jetting section when cleaning is not conducted.

With the invention of Item 21, the influence of the cleaning liquid on a liquid jetted by the liquid jetting section can be minimized by using a cleaning liquid whose properties are similar to those of a liquid jetted by the liquid jetting section.

With the invention of Item 22, appropriate cleaning can be realized by adjusting an impregnation amount of a cleaning liquid in the wiping member with the impregnation amount adjusting means.

With the invention of Item 23, the impregnation amount adjusting means can reduce a thickness of the wiping member by 50% of the thickness–0.5 mm.

With the invention of Item 24, an adjustment to an appropriate impregnation amount of a cleaning liquid can be materialized when the impregnation amount adjusting means reduces a thickness of the wiping member by 50% of the thickness–0.5 mm.

With the invention of Item 25, the fluctuating means can bring the impregnation amount adjusting member into contact with the wiping member in the case of cleaning, and can separate the impregnation amount adjusting member from the wiping member when cleaning is not conducted.

With the invention of Item 26, it makes it possible to clean the liquid jetting section appropriately by wiping the liquid jetting section with the wiping member impregnating the cleaning liquid which has been adjusted in terms of quantity.

With the invention of Item 27, the collecting means can collect an excessive or used cleaning liquid.

With the invention of Item 28, the liquid jetting device can be used for printing on a web.

What is claimed is:

1. A liquid jetting apparatus comprising:

a head having a liquid jetting section;

feeding means for feeding a liquid to the head;

control means for controlling the liquid jetting section to jet the liquid such that a jetting trace of the liquid is recorded on a recording medium;

wiping means for wiping the liquid jetting section of the heads, said wiping means being rotatable and having an outer peripheral surface at least on which a wiping member having a liquid-absorption characteristic is provided;

driving means for rotating the wiping means; and cleaning liquid feeding means for feeding a cleaning liquid to the wiping means, wherein the wiping member is made of a porous material having continued air bubbles, and wherein the wiping member is shaped in a cylinder whose outer diameter is 5 mm to 50 mm and inner diameter is 1 mm to 40 mm.

2. The liquid jetting apparatus of claim 1, wherein the outer peripheral surface of the wiping means is moved relative to the liquid jetting section when wiping the liquid jetting section.

3. The liquid jetting apparatus of claim 1, wherein a relative moving speed of the outer peripheral surface of the wiping means is not higher than 900 mm/sec.

4. The liquid jetting apparatus of claim 1, wherein the porous material has an average porosity of 70% or more.

5. The liquid jetting apparatus of claim 1, wherein the porous material has an average air bubble diameter of 400 μm or less.

6. The liquid jetting apparatus of claim 1, wherein the wiping means comprises shifting means for shifting the wiping member so as to bring the wiping member in contact with or separate the wiping member from the liquid jetting section.

7. The liquid jetting apparatus of claim 1, wherein the cleaning liquid fed by the cleaning liquid feeding means and the liquid jetted from the liquid jetting section have a similar property.

8. The liquid jetting apparatus of claim 1, further comprising absorbed amount regulating means for removing a part of the cleaning liquid absorbed in the wiping member so that an absorbed amount of the cleaning liquid in the wiping member is regulated.

9. The liquid jetting apparatus of claim 8, wherein the wiping member has an outer diameter and the absorbed amount regulating means partially reduces the outer diameter of the wiping member.

10. The liquid jetting apparatus of claim 8, wherein the wiping member has a thickness and the absorbed amount regulating means partially reduces the thickness of the wiping member by 50% or less and 0.5 mm or more.

11. The liquid jetting apparatus of claim 8, wherein the absorbed amount regulating means comprises an absorbed amount regulating member and shifting means for bringing the absorbed amount regulating member in contact with the wiping member or separating the absorbed amount regulating member from the wiping member.

12. The liquid jetting apparatus of claim 8, wherein the wiping means wipes the liquid jetting section with the wiping member after the absorbed amount of the cleaning liquid in the wiping member has been regulated by the absorbed amount regulating means.

13. The liquid jetting apparatus of claim 1, further comprising collecting means for collecting the cleaning liquid.

14. The liquid jetting apparatus of claim 1, wherein the apparatus is adapted to be used for printing on a web.

15. The liquid jetting apparatus of claim 1, wherein the control means controls the liquid jetting section to jet the liquid while the wiping means wipes the liquid jetting section.

16. The liquid jetting apparatus of claim 1, further comprising means for letting the liquid jetting section jet the liquid while the wiping means wipes the liquid jetting section.

17. The liquid jetting apparatus of claim 1, further comprising liquid ejecting means for varying a pressure in the head in plural steps so as to eject the liquid from the liquid jetting section in the head.

18. A liquid jetting apparatus comprising:

a head having a liquid jetting section;

feeding means for feeding a liquid to the head;

control means for controlling the liquid jetting section to jet the liquid such that a jetting trace of the liquid is recorded on a recording medium;

wiping means for wiping the liquid jetting section of the head, said wiping means being rotatable and having an outer peripheral surface at least on which a wiping member having a liquid-absorbing characteristic is provided;

driving means for rotating the wiping means; and cleaning liquid feeding means for feeding a cleaning liquid to the wiping means, wherein a relative moving speed of the outer peripheral surface of the wiping means is not higher than 900 mm/sec.

19. A liquid jetting apparatus comprising:

a head having a liquid jetting section;

feeding means for feeding a liquid to the head;

control means for controlling the liquid jetting section to jet the liquid such that a jetting trace of the liquid is recorded on a recording medium;

wiping means for wiping the liquid jetting section of the heads, said wiping means being rotatable and having an outer peripheral surface at least on which a wiping member having a liquid-absorption characteristic is provided;

driving means for rotating the wiping means;

a cleaning liquid container filled with a cleaning liquid in which the wiping member is immersed to absorb the cleaning liquid; and squeezing means for squeezing the wiping member so that an absorbed amount of the cleaning liquid in the wiping member is regulated.

20. The liquid jetting apparatus of claim 19, wherein the wiping member has a cylindrical shape with an outer diameter of 5 mm to 50 mm and inner diameter of 1 mm to 40 mm.

21. The liquid jetting apparatus of claim 19, wherein the wiping means comprises shifting means for shifting the wiping member so as to bring the wiping member in contact with or separate the wiping member from the liquid jetting section.

22. The liquid jetting apparatus of claim 19, wherein the wiping member has an outer diameter and the squeezing means partially reduces the outer diameter of the wiping member.

23. The liquid jetting apparatus of claim 19, wherein the wiping member has a thickness and the squeezing means partially reduces the thickness of the wiping member by 50% or less and 0.5 mm or more.

24. The liquid jetting apparatus of claim 19, wherein the squeezing means comprises a squeezing member and shifting means for bringing the squeezing member in contact with the wiping member or separating the squeezing member from the wiping member.

25. The liquid jetting apparatus of claim 19, wherein the wiping means wipes the liquid jetting section with the wiping, member after the absorbed amount of the cleaning liquid in the wiping member has been regulated by the squeezing means.

26. The liquid jetting apparatus of claim 19, wherein the control means controls the liquid jetting section to jet the liquid while the wiping means wipes the liquid jetting section.

27. The liquid jetting apparatus of claim 19, further comprises means for letting the liquid jetting section jet the liquid, while wiping means wipes the liquid jetting section.

* * * * *